US006455812B1

(12) United States Patent
Houle

(10) Patent No.: US 6,455,812 B1
(45) Date of Patent: Sep. 24, 2002

(54) PORTABLE FLOORING REMOVAL APPARATUS

(76) Inventor: Marcel Houle, 6, rue Caroline, Victoriaville QBC (CA), G6P 6R8

( * ) Notice: Subject to any disclaimer, the term of this patent is extended or adjusted under 35 U.S.C. 154(b) by 0 days.

(21) Appl. No.: 09/693,882

(22) Filed: Oct. 23, 2000

(51) Int. Cl.[7] ..... H05B 3/00

(52) U.S. Cl. ..... 219/228; 219/533; 156/344; 156/510; 156/584

(58) Field of Search ..... 219/228, 227, 219/241, 506, 533; 156/344, 510, 584; 37/227, 229; 30/DIG. 6, 140; 83/542, 15–16, 170–171

(56) References Cited

U.S. PATENT DOCUMENTS

| | | | | | |
|---|---|---|---|---|---|
| 2,572,791 | A | * | 10/1951 | White | 30/140 |
| 2,622,680 | A | * | 12/1952 | Yakubik | 83/170 |
| 2,655,976 | A | * | 10/1953 | Lovin | 156/344 |
| 2,737,717 | A | * | 3/1956 | Johnson | 219/228 |
| 3,400,244 | A | * | 9/1968 | Meltzer | 219/228 |
| 3,678,581 | A | * | 7/1972 | Bolduc | 30/294 |
| 4,948,451 | A | | 8/1990 | Foltz | |
| 4,981,548 | A | * | 1/1991 | Poll | 156/344 |
| 4,983,809 | A | * | 1/1991 | Maiette et al. | 392/407 |
| 5,060,289 | A | * | 10/1991 | Abramson | 392/423 |
| 5,098,506 | A | | 3/1992 | Brown et al. | |
| 5,140,762 | A | * | 8/1992 | Monson | 372/30 |
| D333,346 | S | * | 2/1993 | Uhde | D23/317 |
| 5,188,013 | A | * | 2/1993 | Cardinale | 83/879 |
| 5,208,895 | A | | 5/1993 | Hoover, Jr. et al. | |
| 5,525,182 | A | | 6/1996 | Miller | |
| 5,709,767 | A | | 1/1998 | Petino | |
| 5,720,844 | A | | 2/1998 | Hanson | |
| 5,772,429 | A | | 6/1998 | Fehrenbach et al. | |
| 5,924,204 | A | * | 7/1999 | Lane | 30/169 |
| 5,948,299 | A | * | 9/1999 | Scalia | 219/228 |

FOREIGN PATENT DOCUMENTS

| | | | | |
|---|---|---|---|---|
| DE | 822518 | * | 10/1951 | 219/228 |
| GB | 1146714 | * | 3/1969 | |
| GB | 2211530 | * | 7/1989 | |
| NL | 86309 | * | 4/1957 | 219/228 |

* cited by examiner

*Primary Examiner*—John A. Jeffery

(57) ABSTRACT

The present invention concerns a portable flooring removal apparatus for the removal of flooring material such as tile, linoleum or the like that is secured to the under flooring by adhesive. The apparatus includes a heating element to melt the bonds and adapted to be connected to a power source, and a cutting element to permit the cutting of uniform sheets of adhered flooring material for easy removal. The apparatus further contains a cooling element to rapidly lower the temperature of the heating element after normal use.

10 Claims, 3 Drawing Sheets

PORTABLE FLOORING REMOVAL APPARATUS

FIELD OF THE INVENTION

The present invention relates generally to an apparatus for the removal of flooring material and more particularly to a portable apparatus which can heat and optionally cut any floor surface covering material that is adhesively secured to a sub-flooring surface.

BACKGROUND OF THE INVENTION

The invention provides a portable flooring removal apparatus for the removal of any flooring material that has been glued to or similarly secured to a sub flooring, as is the case in floor tile or linoleum sheets.

Floor covering materials have become widely used owing to the fact that they are versatile, inexpensive to purchase and install and are easily maintained. They are currently used for commercial and private environments. However, the removal of such flooring material is both a labor intensive and time-consuming endeavor. In situations where the covering material was in the form of a tile, the worker had to tear the tiles from the floor one by one. In the case where the flooring was laid down in a uniform sheet one or more workers had to cut and pull the sheet from the sub flooring and loosen the adhesive bonds with knives and metal scrapers. There seems to be a need in the industry for an improved method of removing these flooring materials.

Various devices exist on the market for the removal of flooring surfaces. One variety of machines is geared towards the breakdown of asbestos containing floor tiles. U.S. Pat. No. 5,709,767 granted on Jan. 20, 1998 to Petino discloses a method and apparatus for the removal of asbestos floor tiles.

The apparatus works by the exposure of floor tiles to low temperatures with the aid of dry ice and maintaining the tile at low temperatures until the underlying bonding material looses its bonding properties. U.S. Pat. No. 5,098,506 granted on Mar. 24, 1992 to Brown et al shows a method and apparatus for the removal of asbestos containing floor tile mastic by exposing the surface tile to a quantity of water sufficient to wet the asbestos containing material and dissolve the bonds. The procedure then requires the scouring of the tile to remove it. A specific HEPA (high efficiency particulate) filter is supplied to filter the water and air.

U.S. Pat. No. 5,525,182 granted to Miller on Jun. 11, 1996 discloses a large grade self sufficient apparatus having both a heat source and a contained water supply source to enable the removal of adhesively secured floor tile. The apparatus is fuelled by a fully contained propane fuel tank.

U.S. Pat. No. 4,983,809 granted to Maiette et al on Jan. 8, 1991 is also a large grade self sufficient apparatus which heats deeply imbedded floor tiles and subsequently uses a suction cup to lift and remove the tiles. This situation is ideal for the removal of heavy tiles containing dangerous materials. With such large apparatus, it is practically impossible to go under floor overhanging cupboards and remove any covering therefrom.

A different category of machines is geared towards the removal of loose floor covering such as carpets but do not treat the issue of breaking down adhesive bonds. U.S. Pat. No. 4,948,451 granted to Foltz on Aug. 14, 1990 is a floor covering apparatus where a set of rollers designed to pull the carpet off its supporting surface. U.S. Pat. No. 5,720,844 granted to Hanson discloses an apparatus that selectively feeds a desired width of floor covering through the apparatus with the help of a set of interlocking gears. Although effective for the removal of loose floor covering it did not prove effective for the removal of flooring materials that were adhesively secured to the sub flooring such as tiles or linoleum sheets.

An alternate apparatus is disclosed in U.S. Pat No. 5,208,895 granted to Hoover et al on May 4, 1993. This apparatus is a hand held scraper for the removal of paint, wallpaper or linoleum tile using heat and steam. Although this apparatus was effective for small areas this machine is not effective for situations where it is necessary to cut and remove linoleum from floors.

This grouping of prior art did not provide a means for dissociating the adhesive bond that secures the flooring material to the sub floor.

OBJECTS OF THE INVENTION

It is therefore a general object of the present invention to provide a portable flooring removal apparatus of the character described which obviates the above noted disadvantages.

It is an object of the present invention to provide a portable flooring removal apparatus that can be effectively operated by a single worker.

It is a further object of the present invention to provide a portable flooring removal apparatus that is easily transportable by a layman.

A further object of the present invention is to provide a portable flooring removal apparatus that can cut uniform sheets of floor covering material into easily removable sections.

Still a further object of the present invention is to provide a portable flooring removal apparatus that can cut up uniform sheets of floor covering without the necessity of the worker to lean down and cut up the linoleum manually.

Still a further object of the present invention is to provide a portable flooring removal apparatus that uses electricity as its power source and does not require an alternate fuel source.

Yet another object of the invention is to provide a portable flooring removal apparatus that is capable of running under any floor overhanging cupboards and the like to remove the floor covering therefrom.

Another object of the invention is to provide a portable flooring removal apparatus that is safe and well constructed while requiring a low maintenance.

Each of the foregoing advantages of this invention is achieved with a relatively simple structure that may be manufactured at a minimum cost.

Additional advantages of the present invention will become apparent from the description that follows, taken in conjuncture with the accompanying drawings.

SUMMARY OF THE INVENTION

According to the present invention, there is provided a flooring removal apparatus for removing a floor surface from a sub-floor and bonded on the same, said apparatus comprises a heating element for heating a base plate secured to a frame structure and adapted to be connected to a power source, said frame structure having a front and a rear ends separated by side portions, said front end being adapted to releasably receive a handle member, said rear end and side portions having ledges adapted to run under floor overhanging cupboards and the like obstacles.

Preferably, the base plate of said structure is composed of a highly heat conductive material.

Preferably, the apparatus further comprises a cooling element to cool down said heating element after normal use of said apparatus.

Preferably, the apparatus further comprises a cutting element releasably secured to the rear end of the frame structure, said cutting element carrying at least two cutting devices located along said side portions respectively.

Preferably, the handle member is pivotably secured to the frame structure and extending upwardly and frontwardly therefrom.

Preferably, the base plate includes floor surface engaging members adapted to ease displacement of the apparatus onto said floor surface.

Preferably, the floor surface engaging members are a plurality of wheels rotatably mounted to the base plate of the frame structure.

Preferably, the apparatus further comprises a temperature control system to maintain the temperature of the heating element to a user set temperature.

Preferably, the temperature control system includes a control circuit connected to a temperature setting knob for a user to set the temperature of the heating element and to a temperature sensor for sensing the same.

Preferably, the temperature control system further includes a heating witness light to confirm to the user that power is going through said heating element.

Preferably, the cutting devices are spring biased against said floor surface for properly cutting the same.

Preferably, the apparatus further comprises a power connection witness light to confirm to a user that power is available from said power source.

Preferably, the power source is an external 230 VAC source connected through an electrical cord.

BRIEF DESCRIPTION OF THE DRAWINGS

In the annexed drawings, like reference characters indicate like elements throughout.

DETAILED DESCRIPTION OF THE PREFERRED EMBODIMENT

With reference to the annexed drawings the preferred embodiment of the present invention will be herein described for indicative purposes and by no means as of limitation.

Figure 1:
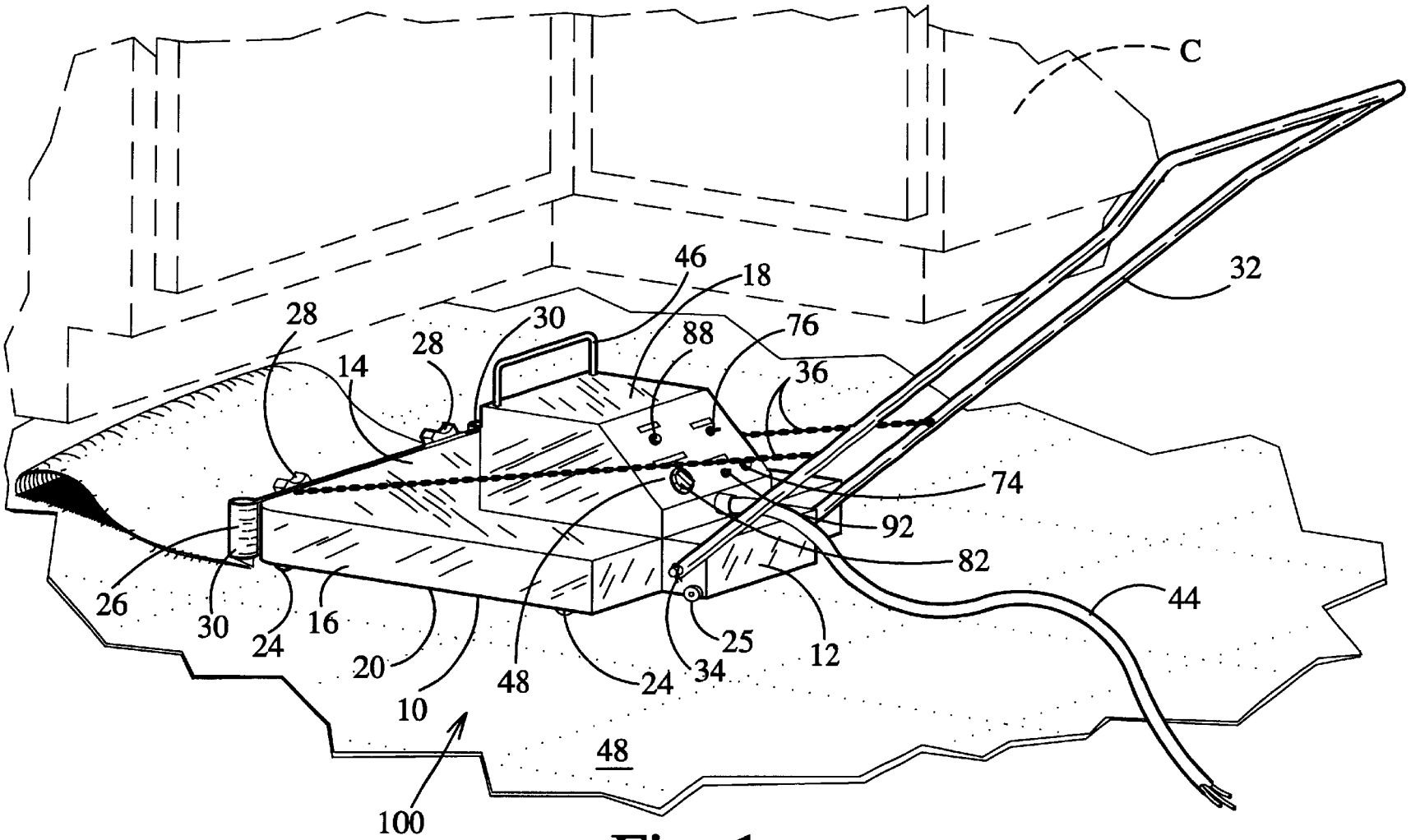
FIG. 1 is a perspective view of an embodiment of a flooring removal apparatus designed in accordance with the present invention.
Figure 2:
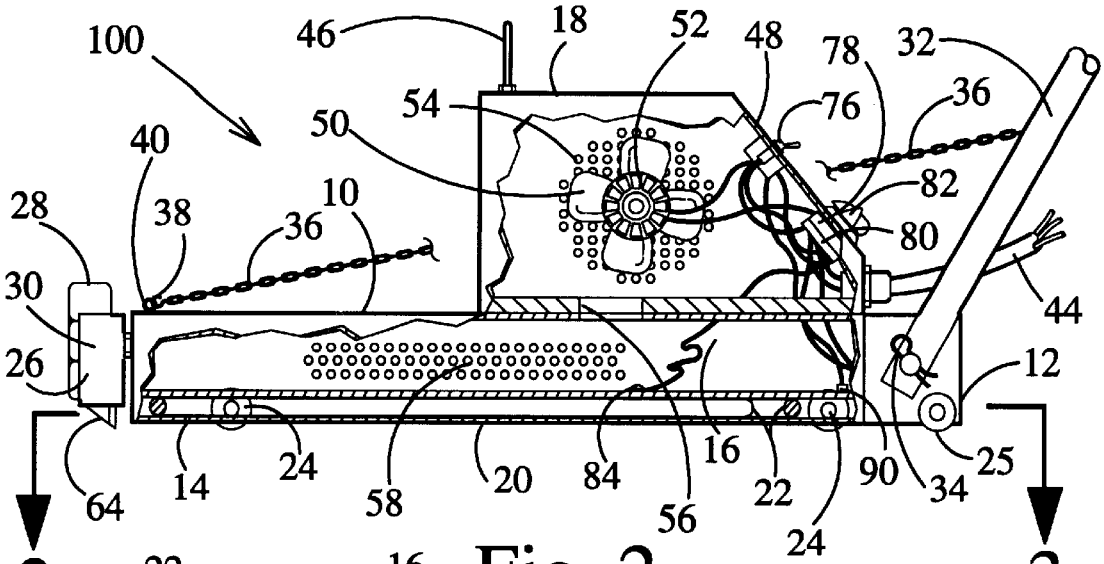
FIG. 2 is a partially sectioned side view of the embodiment of FIG. 1.
Figure 3:
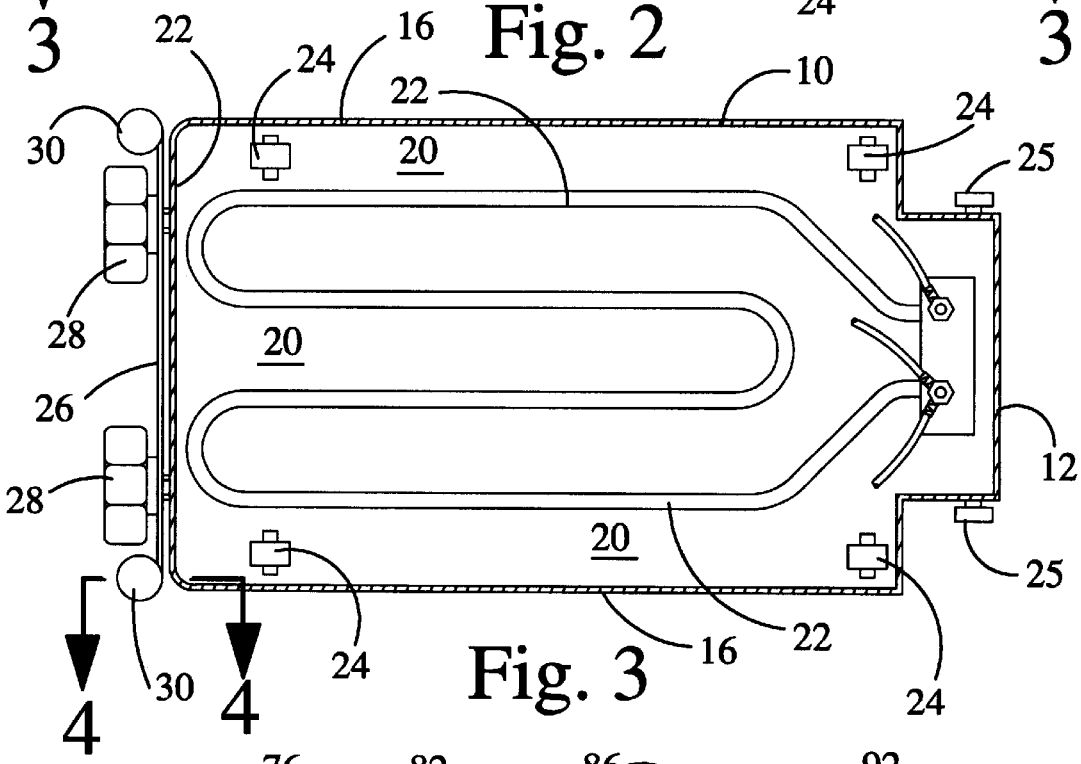
FIG. 3 is a section view taken along line 3—3 of FIG. 2.

Referring to FIGS. 1 to 3, there is shown an embodiment 100 of a flooring removal apparatus according to the present invention for removing a floor surface F from a sub-floor and bonded on the same. The apparatus 100 includes a frame structure 10 having a front end 12 and a rear end 14, separated by side portions 16, and supporting a top section 18. The rear end 14 and the side portions 16 are adapted to run under floor overhanging cupboards C and the like obstacles, as shown in FIG. 1.

To the structure 10 there is further attached a heat conductive base plate 20 onto which is secured a heating element 22, preferably a standard kitchen oven type of element. A plurality of floor engaging members 24, 25 preferably brass wheels, are rotatably mounted to the base plate 20 to ease the displacement of the apparatus 100 onto the floor F.

A cutting element 26 is releasably attached to the rear end 14 frame structure 10 by securing knobs 28. The cutting element 26 preferably includes two cutting devices 30 located along the side portions 16 respectively. The fact that the cutting element 26 is removable from the structure 10 is ideal for transportation.

A handle member 32 frontwardly and upwardly extends from the front end 12 for a user to generally pull the apparatus 100. The handle 32 is pivotally secured to the latter and releasably secured therefrom via clips 34. The handle 32 is further releasably attached to the rear end 14 of the structure 10 by two chains 36 terminated with hooks 38 engaging respective ring 40. The user may lift the rear end 14 of the frame structure 10 by pushing down on the handle 32. This allows the user to maneuver the apparatus 100 across the floor F using wheels 25 of the front end 12, as well as disrupt contact of the base plate 20 with floor surface if he so wishes. The apparatus 100 is preferably connected to an electrical power source 42, such as a 230 VAC source, via electrical cord 44.

As shown in FIG. 2, the top section 18 includes a lifting handle 46, essentially centered with the weight of the structure 10, a control panel 48 and a cooling element 50. The cooling element 50, preferably a fan 52, is used to help the heating element 22 to cool down faster after normal use of the apparatus 100. The fan 52 facilitates the circulation of air from an air inlet 54 on the top section 18 to the base plate 20 through an air vent 56 and out the air outlet 58, located on at least one of the side portions 16.

The base plate 22 is preferably made out of a highly heat conductive material such as aluminum while the rest of the frame structure 10, handle 32 and lifting handle 46 are preferably made out of strong structural material such as stainless steel, preferably.

Figure 4:
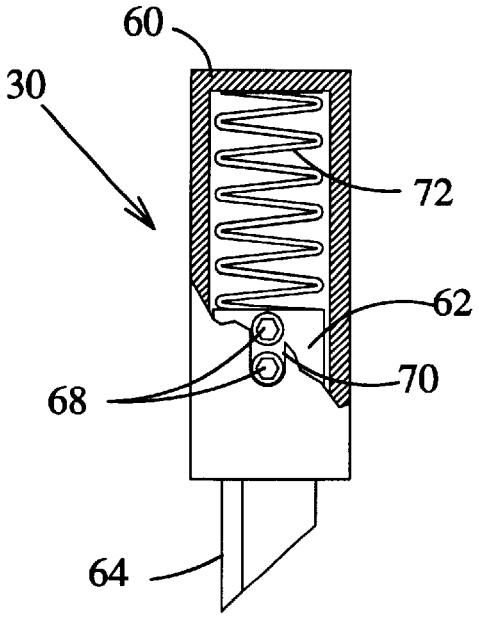
FIGS. 4 & 4*a* are enlarged partially sectioned views taken along line 4—4 of FIG. 3, showing the cutting device in its biased and retracted positions respectively.
Figure 4A:
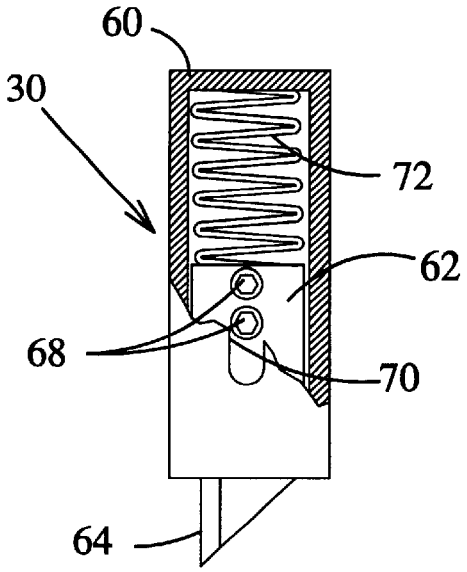
Figure 5:
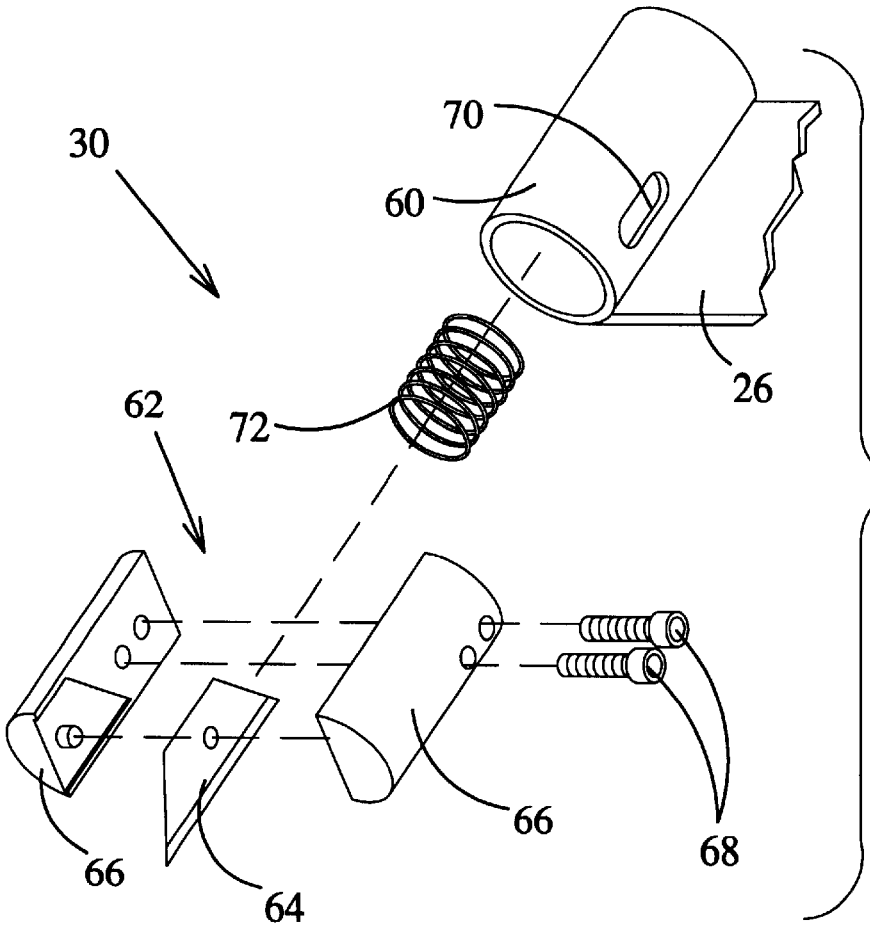
FIG. 5 is an exploded perspective view of the cutting element of the embodiment of FIG. 1.

As shown in FIGS. 4, 4*a* and 5, each cutting device 30 preferably includes a housing 60 adapted to slidably receive a cutter 62 made out of a sharp blade 64 squeezed in between two plates 66 held together via screws 68. The cutter 62 slides between a spring biased expanded and a retracted limit positions shown in FIGS. 4 and 4*a* respectively and corresponding to screws 68 secured to the cutter 62 and abutting to the extremities of a slot hole 70 of the housing 60. A standard coil spring 72 is preferably used to bias the cutter 62 in its expanded position to properly cut the portion of the covering of the floor F to be removed.

Figure 6:
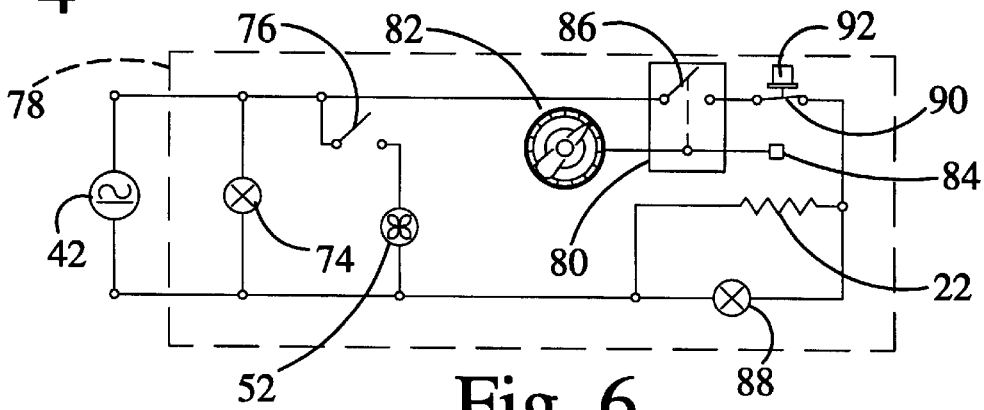
FIG. 6 is an electrical circuit diagram of the embodiment of FIG. 1.

FIG. 6 shows the electrical circuit diagram of the preferred embodiment 100 of the present invention. The physical connection of the power cord 44 to the power source 42 is monitored by the power connection witness visual indicator, preferably a light 74. The fan 52 is controlled by the user via the fan control switch 76. The control panel 48 also includes a temperature control system 78 preferably having a control circuit 80 connected to a temperature setting knob 82, for the user to set the temperature of the heating element 22 and to a temperature sensor 84 for sensing the same, and connected to a thermal control switch 86 for regulating the temperature of the heating element 22 to the user set temperature. The system 78 further includes a heating witness visual indicator, preferably a light 88, to advise the user that the heating element 22 is heating to reach the set temperature. As a safety feature, an overheating safety switch 90 series connected to the heating element 22 detects overheating of the latter and automatically shuts off the power going to the same. Preferably, the safety switch 90 is a bimetallic element operating at a pre-determined temperature and is located on the base plate 20. In case of activation of the safety switch 90, there is a reset button 92 to be pushed by the user to reset the latter in a configuration ready to be activated again.

Although the present portable flooring removal apparatus has been described with a certain degree of particularity, it is to be understood that the disclosure has been made by way of example only and that the present invention is not limited to the features of the embodiment described and illustrated herein, but includes all variations and modifications within the scope and spirit of the invention as hereinafter claimed.

I claim:

1. A sheet removing apparatus for removing a sheet section part of a generally continuous sheet of covering material adhesively bounded by an adhesive to a floor surface, said sheet section defining a pair of generally opposed sheet section side edges, said floor surface defining a floor surface peripheral edge; said floor surface peripheral edge being at least partially in an underlying relationship relative to an overriding structure, said overriding structure being spaced from said sheet of covering material by a sheet-to-structure spacing distance; said apparatus comprising:

a heat generating means for generating a predetermined amount of thermal energy, said heat generating means including an electrically resistive heating component;

a protective casing for protectively enclosing said heating component, said casing defining a casing front end, a casing rear end, a pair of generally opposed casing side ends and a casing axis extending between said front end and said rear end; said protective casing including a top wall, a base wall and a peripheral wall extending between the peripheral edges of said top and base walls, said base wall defining a base wall inner surface, a base wall outer surface, a base wall front edge, a base wall rear edge and a pair of generally opposed base wall side edges; said top, base and peripheral walls together encompassing a casing inner volume; said base wall inner surface being positioned generally adjacent said heating component so as to allow said base wall to be heated by said thermal energy generated by said heating component and to diffuse said thermal energy underneath said base wall over said sheet section when said base wall is positioned over said sheet section;

a sheet cutting means for cutting said sheet of covering material adjacent said sheet section side edges, said sheet cutting means including a pair of cutting blades, each of said cutting blades extending in a blade axial direction generally perpendicular relative to said base plate, each of said cutting blades being attached to said protective casing in a laterally spaced relationship relative to the other cutting blade and adjacent a corresponding one of said casing side ends; each of said cutting blades defining a generally rectilinear cutting edge, each of said cutting edges protruding downwardly from a position generally adjacent a corresponding one of said base wall side edges and being oriented along a corresponding cutting axis that extends in a direction generally parallel to said casing axis so as to form a pair of generally parallel and laterally spaced apart incisions in said sheet of covering material when said casing is moved in the direction of said casing axis;

a floor contacting and spacing means for both allowing movement of said casing along said floor surface and maintaining said base wall outer surface in a predetermined spaced relationship relative to said floor surface;

whereby upon said casing being moved in the direction of said casing axis along said floor surface over said sheet section, said adhesive bounding said sheet section to said floor will be softened by the thermal energy generated by said heating component and diffused over said sheet section and, simultaneously, said cutting edges will form a pair of incisions along said sheet section side edges, said incisions being in a parallel relationship relative to each other and oriented in the direction of said casing axis so as to allow said sheet section to be subsequently pealed of said floor surface.

2. A sheet removing apparatus as recited in claim 1 wherein said protective casing has a cooling aperture extending therethrough and wherein said sheet removing apparatus further comprises a base plate cooling means for selectively cooling said base plate, said base plate cooling means including a blower component mounted on said protective casing so as to be in fluid communication with said casing inner volume through said cooling aperture, said blower being provided with a selective blower activation means for selectively activating said blower component so as to selectively cool said base plate by selectively blowing air into said casing inner volume, said base plate cooling means allowing cooling of said base plate both when said apparatus is moving and in a fixed relationship relative to said floor surface.

3. A sheet removing apparatus as recited in claim 1 wherein said protective casing has a generally flat rectangular parallelepiped-shaped configuration with said base and top wall in a generally adjacent relationship relative to each other, said blower component being mounted within a blower housing, said blower housing having at least one air inlet aperture extending therethrough and wherein said protective casing is provided with at least one air outlet aperture extending therethrough, said blower housing being mounted on said top wall and said cooling aperture being correspondingly formed in said top wall, said blower housing defining a blower housing peripheral wall extending generally perpendicularly from said top wall, said blower housing peripheral wall being spaced from the peripheral edges of said top wall so as to define a peripheral clearance between said blower housing peripheral wall and the peripheral edges of said top wall; whereby, when the distance between said top and base walls is smaller then said sheet-to-structure spacing said peripheral clearance allows said sheet removing apparatus to be maneuvered adjacent said floor peripheral edge with said peripheral clearance inserted underneath said overlying object.

4. A sheet removing apparatus as recited in claim 1 wherein said electrically resistive heating component includes a heat resistant wire for locally generating thermal energy in a region adjacent to the pattern taken by said wire and wherein:

said base plate is made out of a generally highly heat conductive material so as to facilitate both the diffusion of the thermal energy generated by said heat generating means over the entire surface of said base plate and the cooling of said base plate by said base plate cooling means when needed.

5. A sheet removing apparatus as recited in claim 1 wherein each of said cutting blades is slidably attached to said casing so as to be movable along said blade axial direction between a blade extended configuration wherein said cutting edge protrudes from said base plate and a blade retracted configuration wherein said cutting edge is retracted relative to said base plate.

6. A sheet removing apparatus as recited in claim 5 wherein each of said cutting blades is resiliently biased towards said blade extended configuration.

7. A sheet removing apparatus as recited in claim 6 wherein each of said cutting blades is slidably mounted within a corresponding blade housing releasably attached to said casing.

8. A sheet removing apparatus for removing a sheet section part of a generally continuous sheet of covering material adhesively bounded by an adhesive to a floor surface, said sheet section defining a pair of generally opposed sheet section side edges, said floor surface defining a floor surface peripheral edge; said floor surface peripheral edge being at least partially in an underlying relationship relative to an overriding structure, said overriding structure being spaced from said sheet of covering material by a sheet-to-structure spacing distance; said apparatus comprising:

a heat generating means for generating a predetermined amount of thermal energy, said heat generating means including an electrically resistive heating component, said electrically resistive heating component including a heat resistant wire for locally generating thermal energy in a region adjacent to the pattern taken by said wire;

a protective casing for protectively enclosing said heating component, said casing defining a casing front end, a casing rear end, a pair of generally opposed casing side ends and a casing axis extending between said front end and said rear end; said protective casing including a top wall, a base wall and a peripheral wall extending between the peripheral edges of said top and base walls, said base wall defining a base wall inner surface, a base wall outer surface, a base wall front edge, a base wall rear edge and a pair of generally opposed base wall side edges; said top, base and peripheral walls together encompassing a casing inner volume; said base wall inner surface being positioned generally adjacent said heating component so as to allow said base wall to be heated by said thermal energy generated by said heating component and to diffuse said thermal energy underneath said base wall over said sheet section when said base wall is positioned over said sheet section;

said protective casing having a cooling aperture extending therethrough a sheet cutting means for cutting said sheet of covering material adjacent said sheet section side edges, said sheet cutting means including a pair of cutting blades, each of said cutting blades extending in a blade axial direction generally perpendicular relative to said base plate, each of said cutting blades being attached to said protective casing in a laterally spaced relationship relative to the other cutting blade and adjacent a corresponding one of said casing side ends; each of said cutting blades defining a generally rectilinear cutting edge, each of said cutting edges protruding downwardly from a position generally adjacent a corresponding one of said base wall side edges and being oriented along a corresponding cutting axis that extends in a direction generally parallel to said casing axis so as to form a pair of generally parallel and laterally spaced apart incisions in said sheet of covering material when said casing is moved in the direction of said casing axis; each of said cutting blades being slidably attached to said casing so as to be movable along said blade axial direction between a blade extended configuration wherein said cutting edge protrudes from said base plate and a blade retracted configuration wherein said cutting edge is retracted relative to said base plate; each of said cutting blades being resiliently biased towards said blade extended configuration;

a floor contacting and spacing means for both allowing movement of said casing along said floor surface and maintaining said base wail outer surface in a predetermined spaced relationship relative to said floor surface;

whereby upon said casing being moved in the direction of said casing axis along said floor surface over said sheet section;

said adhesive bounding said sheet section to said floor will be softened by the thermal energy generated by said heating component and diffused over said sheet section and, simultaneously;

said cutting edges will form a pair of incisions along said sheet section side edges, said incisions being in a parallel relationship relative to each other and oriented in the direction of said casing axis so as to allow said sheet section to be subsequently pealed of said floor surface;

said sheet removing apparatus further comprising a base plate cooling means for selectively cooling said base plate, said base plate cooling means including a blower component mounted on said protective casing so as to be in fluid communication with said casing inner volume through said cooling aperture, said blower being provided with a selective blower activation means for selectively activating said blower component so as to selectively cool said base plate by selectively blowing air into said casing inner volume, said base plate cooling means allowing cooling of said base plate both when said apparatus is moving and in a fixed relationship relative to said floor surface;

said base plate being made out of a generally highly heat conductive material so as to facilitate both the diffusion of the thermal energy generated by said heat generating means over the entire surface of said base plate and the cooling of said base plate by said base plate cooling means when needed.

9. A sheet removing apparatus as recited in claim 8 wherein each of said cutting blades is slidably mounted within a corresponding blade housing, both of said blade housings being solidarly mounted on a housing attachment plate, said housing attachment plate being releasably attached to said protective casing.

10. A sheet removing apparatus as recited in claim 9 wherein said protective casing has a generally flat rectangular parallelepiped-shaped configuration with said base and top wall in a generally adjacent relationship relative to each other, said blower component being mounted within a blower housing, said blower housing having at least one air inlet aperture extending therethrough and wherein said protective casing is provided with at least one air outlet aperture extending therethrough, said blower housing being mounted on said top wall and said cooling aperture being correspondingly formed in said top wall, said blower housing defining a blower housing peripheral wall extending generally perpendicularly from said top wall, said blower housing peripheral wall being spaced from the peripheral edges of said top wall so as to define a peripheral clearance between said blower housing peripheral wall and the peripheral edges of said top wall; whereby, when the distance between said top and base walls is smaller then said sheet-to-structure spacing said peripheral clearance allows said sheet removing apparatus to be maneuvered adjacent said floor peripheral edge with said peripheral clearance inserted underneath said overlying object.

* * * * *